US006904686B1

(12) United States Patent
James

(10) Patent No.: US 6,904,686 B1
(45) Date of Patent: Jun. 14, 2005

(54) SLAT RIPPER

(76) Inventor: Dennis James, 2732 El Portal Dr., #2, San Pablo, CA (US) 94806

( * ) Notice: Subject to any disclaimer, the term of this patent is extended or adjusted under 35 U.S.C. 154(b) by 0 days.

(21) Appl. No.: 10/210,271

(22) Filed: Aug. 1, 2002

(51) Int. Cl.[7] ..... B26B 3/00; B26B 3/08

(52) U.S. Cl. ..... 30/278; 30/280; 30/289; 30/294; 30/314

(58) Field of Search ..... 30/90.4, 90.6, 30/90.7, 90.8, 90.9, 91.1, 92.5, 278, 279.2, 30/280, 281, 294, 299, 301, 302, 303, 314, 30/315, 316, 317, 289; 452/148

(56) References Cited

U.S. PATENT DOCUMENTS

| | | | | | |
|---|---|---|---|---|---|
| 2,247,840 | A | * | 7/1941 | Harrison | 30/289 |
| 2,263,531 | A | * | 11/1941 | Kevorkian | 30/301 |
| 2,675,580 | A | * | 4/1954 | Pesce | 30/294 X |
| 2,686,690 | A | * | 8/1954 | Kushnir | 30/316 X |
| 3,127,939 | A | * | 4/1964 | Rink | 30/316 X |
| 4,209,903 | A | * | 7/1980 | Owens | 30/302 |
| 4,873,991 | A | * | 10/1989 | Skinner | 30/280 X |
| 6,058,610 | A | * | 5/2000 | Leang | 30/316 |

* cited by examiner

*Primary Examiner*—Clark F. Dexter
(74) *Attorney, Agent, or Firm*—Charles L. Thoeming

(57) ABSTRACT

A one-piece, hand-held slat ripper for cutting slat, such as vinyl fencing slat, in lengths of uniform width, which includes an enclosed channel of uniform rectangular cross-sectional area housing a blade safely disposed within the channel.

14 Claims, 2 Drawing Sheets

SLAT RIPPER

CROSS-REFERENCES TO RELATED APPLICATIONS

None.

STATEMENT REGARDING FEDERALLY SPONSORED RESEARCH OR DEVELOPMENT

None.

REFERENCE TO A MICRO-FICHE APPENDIX

None.

BACKGROUND OF THE INVENTION

1. Field of the Invention

The present invention relates to a light weight, hand-held cutting tool and more directly to a slat ripper for use in easily narrowing standard widths of fencing slats to narrower slats of a predetermined, uniform width.

2. Description of the Related Art including Information Disclosed under 37 C.F.R. 1.97 and 1.98

A search of the prior art located the following United States patents which are believed to be representative of the present state of the prior art: U.S. Pat. No. 4,064,626, issued Dec. 27, 1977, U.S. Pat. No. 4,096,631, issued Jun. 27, 1978, U.S. Pat. No. 4,438,563, issued Mar. 27, 1984, U.S. Pat. No. 4,870,756, issued Oct. 3, 1989, U.S. Pat. No. 5,581,894, issued Dec. 10, 1996, and U.S. Pat. No. 6,135,001, issued Oct. 24, 2000.

Cutting tools in the art typically involve multiple parts and are cumbersome or unwieldy for use by a single operator in construction site applications. The prior art also involves having to adjust blade position according to the application, and often lack any self-contained channel alignment for the material to be ripped or cut.

Absent the cited art, means for ripping slat also include manually measuring and then marking the width desired and cutting along a line drawn on the slat using scissors, shears, or a standard utility knife.

BRIEF SUMMARY OF THE INVENTION

The present invention is a light weight, hand-held cutting tool and, more directly, a slat ripper for use in easily and quickly narrowing standard widths of slats, principally vinyl fencing slats, to narrower slats of a predetermined, uniform desired width. The design of a preferred embodiment of the present invention allows a single operator to hold the apparatus in one hand and align one slat by width within the channel of the apparatus with the other hand, and with an ease of motion rip the slats into two corresponding lengths of predetermined width. The apparatus also easily can be used by two or more operators, depending upon the desired use. The cutting means of the present invention is safely positioned within the apparatus preventing accidental encounter by, and resulting injury to, the operator. Alternate embodiments of the present invention can be used on a fixedly secured stand, or be sized to receive and rip more than one slat at a time.

Thus, it is an object of the present invention to provide an improved slat ripper of unitary construction.

It is a further object of the present invention to provide an improved slat ripper which can be easily used by a single operator, or by a plurality of operators, to rip one or more slats to predetermined uniform widths.

It is still a further object of the present invention to provide an improved slat ripper which can be used by a single operator, or by a plurality of operators, to quickly rip one or more slats to predetermined uniform widths.

It is yet a further object of the present invention to provide an improved slat ripper which protects the user from contact with the cutting means.

It is yet another object of the present invention to provide an improved slat ripper which is simple and inexpensive to manufacture.

It is still yet another object of the present invention to provide an improved slat ripper which is light weight, yet sturdy, for unlimited portability on construction job sites by a single operator.

It is yet another object of the present invention to provide an improved slat ripper which has a single, fixed cutting means.

It is still another object of the present invention to provide an improved slat ripper which provides a channel of predetermined size to align the slat material(s) to be ripped.

Other features, advantages, and objects of the present invention will become apparent with reference to the following description and accompanying drawings.

BRIEF DESCRIPTION OF DRAWINGS

The foregoing summary, together with the following detailed description of various embodiments, is better appreciated and understood when considered together with the appended drawings. For the purpose of illustrating the invention, the drawings illustrate an embodiment that is presently preferred, and two related embodiments. The invention is not limited, however, to the specific methods or instrumentalities disclosed in the drawings. In the drawings.

DETAILED DESCRIPTION OF THE INVENTION

Figure 1:
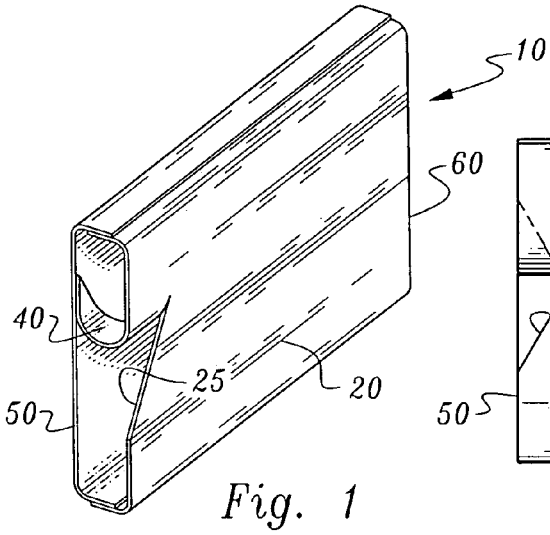
FIG. 1 is a perspective view of the slat ripper according to the invention.
Figure 2:
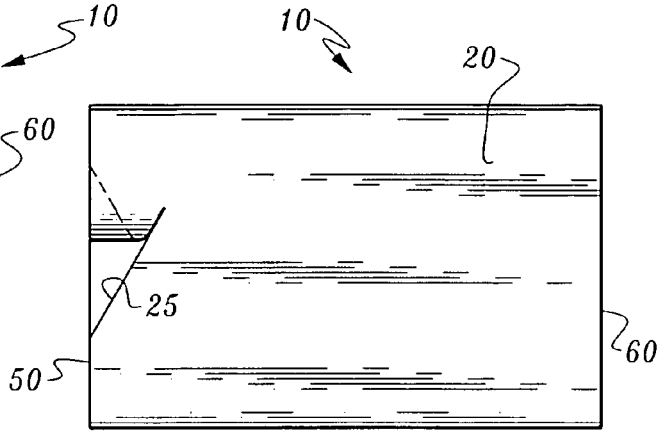
FIG. 2 is an elevational view of the top side of the slat ripper.

Referring initially to FIGS. 1–5, the slat ripper 10 of the present invention, comprises a hollow body having a top wall 20, a bottom wall 30, two side walls 45 and 46, a back end 50, and a front end 60, and wherein the ends of the body are open and define a chamber of uniform cross-sectional geometry 70. Each of the walls has an inside and an outside face in relation to the chamber 70 formed thereby. The slat ripper 10 has a cutting means 40 fixedly disposed within the body chamber 70 between and attached to the inside faces of the top wall 20 and the bottom wall 30, wherein the functional end of the cutting means is exposed only to the internal portion of the chamber 70. As more particularly detailed in FIGS. 1, 4 and 5, the cutting means further comprises a slot 25 that is cut into the back end of the top wall 20 wherein the cut wall material is bent perpendicularly to the top wall and curved inwards toward the inside face of the bottom wall. The inner edge of the cut top wall material is sharpened to form a blade edge 41 facing inwards towards the front end 60 of the chamber 70. FIG. 2 shows the slot 25 as a right triangle in the top wall, with the base of the triangle along the apparatus back end 50 and the height of the triangle perpendicular to the back end 50. As shown in FIGS. 1–5, the bottom portion of the cut top wall material is curved around to lay flat upon the inside face of the bottom wall 30. This curved portion can be spot welded to the inside face of the bottom wall; however, the curved nature of the cut top wall material and its preferred material of construction are sufficient to keep the blade in the desired cutting position over the life of the apparatus. Thus, the preferred embodiment of the present invention provides an apparatus of unitary, fixed construction, wherein the sharpened blade cutting means 40 is a portion of the top side 20. This feature of the present invention is critical to protect the user from contact with the sharpened blade edge.

Figure 3:
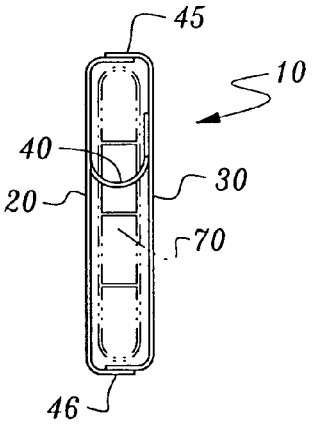
FIG. 3 is an elevational view of the back end of the slat ripper with slat fitted into the front end.
Figure 4:
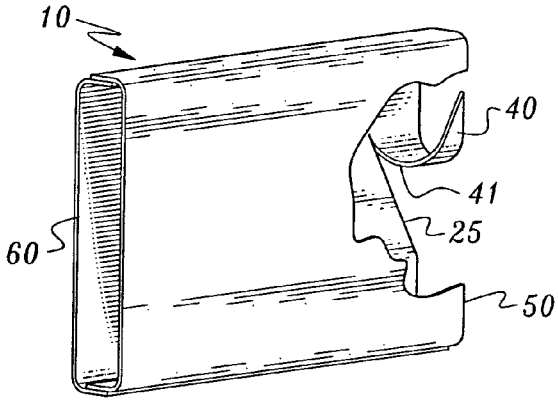
FIG. 4 is a cut-away plan view of the bottom side of the slat ripper showing the blade element.
Figure 5:
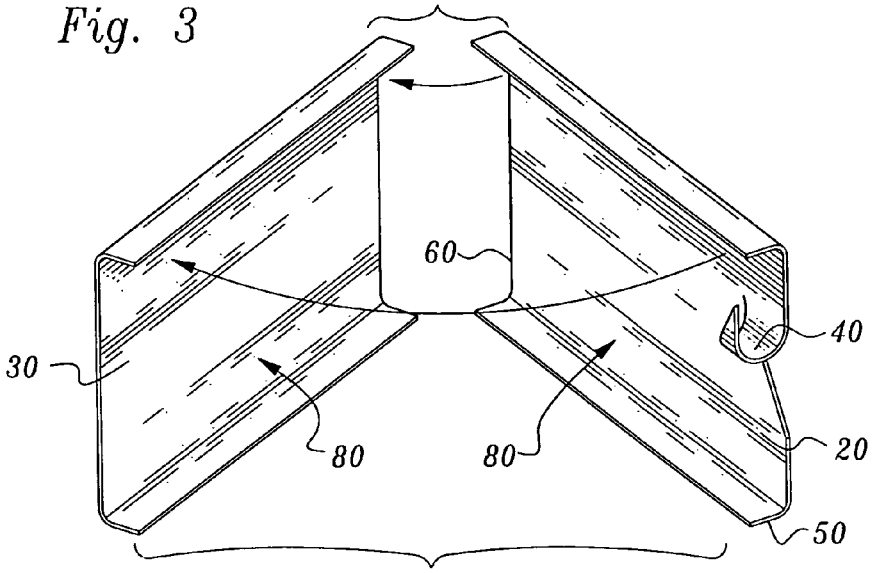
FIG. 5 is a perspective view of the top and bottom halves of the slat ripper.

FIGS. 3 and 5 depict the preferred embodiment of the slat ripper body as comprising two equal sized, U-shaped channels 80 with means to fixedly attached one channel to the other with an outside face of one channel wall attached to an inside face of the other channel wall to form one conjoined side, and the reverse relationship with respect to the respective inside-outside faces of the channel walls on the other conjoined side. Thus attached, the channels 80 to provide the hollow body, or chamber 70, having a top wall 20, bottom wall 30, and aide walls, 45 and 46, wherein the ends of the body are open and define the chamber of uniform cross-sectional geometry 70. The uniform cross-sectional geometry for the preferred embodiment of the present invention is a rectangle with the top wall 20 and bottom wall 30 portions of the rectangle being equal lengths greater than the equal lengths of the side walls, 45 and 46, as shown in FIGS. 1, 3 and 4. This feature is critical in providing a slat ripper that is light weight and sturdy, easy to grip in one hand, and which serves to guide the slat towards the sharpened blade when used.

The cross-sectional area of the chamber 70 is sized slightly larger than the cross-sectional area of at least one slat wherein the apparatus can receive at least one slat along the chamber longitudinal axis of the apparatus as shown in FIGS. 3, 6–9. The preferred embodiment of the ripper apparatus is constructed of twenty gauge stainless steel, although similar materials of light weight and strength, such as molded, high impact graphite, are suitable for achieving the desired objectives of the present invention. The two identical, stainless steel channels 80 can be fitted together as indicated in FIGS. 3 and 5, and fixedly attached with two spot welds equidistantly spaced on each side wall, 45 and 46.

The preferred embodiment of the present invention provides a hollow body with an external height dimension of 0.5 inches, an external width dimension of 2.5 inches, and an external length dimension of 4.0 inches. For the preferred embodiment of the present invention, the blade length is approximately ⅞ inches, and the blade is 1.5 inches from the external side of the right side wall 46 when viewing the top wall from above with the front end oriented on a north polar axis thereto. The dimensions of the triangle provided by the slot cut 25 of FIG. 2 are a hypotenuse of 1.25 inches, a height of ⅝ inches, and a base of ⅞ inches.

An alternate embodiment of the present invention provides a hollow body further comprising an external height dimension of 0.5 inches, and external width dimension of $2\frac{15}{16}$ inches, and an external length dimension of 4.0 inches. For this alternate embodiment of the present invention, the blade length is approximately ⅞ inches, and the blade is 1.5 inches from the external side of the right side wall 46 when viewing the top wall from above with the front end oriented on a north polar axis thereto. The dimensions of the triangle provided by the slot 25 of FIG. 2 are a hypotenuse of 1.25 inches, a height of ⅝ inches, and a base of ⅞ inches.

Figure 6:
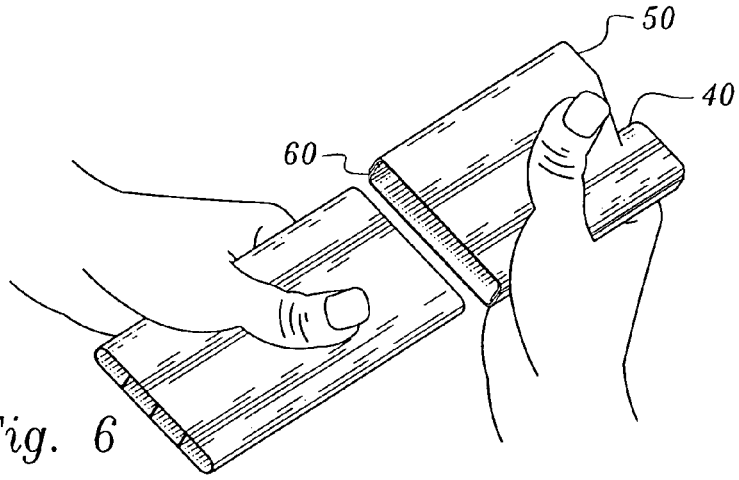
FIG. 6 is a plan view of use of the slat ripper showing a slat being manually aligned with the front end of the ripper.
Figure 7:
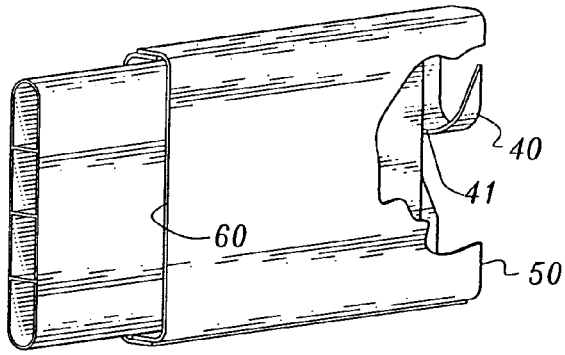
FIG. 7 is a cut-away plan view of the bottom side of the slat ripper with a slat inserted showing the blade element.
Figure 8:
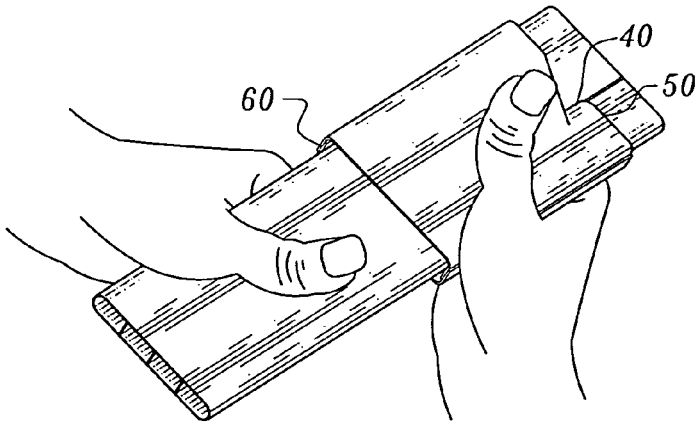
FIG. 8 is a plan view of use of the slat ripper showing a slat being manually ripped.
Figure 9:
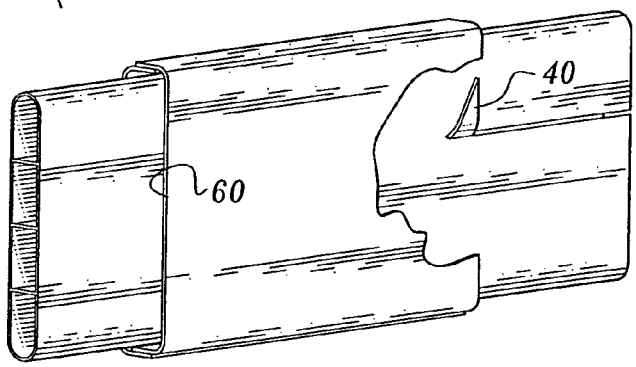
FIG. 9 is a cut-away plan view of the bottom side of the slat ripper showing the blade element ripping a slat.

The method of using the improved apparatus for slat ripping of the present invention, comprises providing an improved apparatus for slat ripping of desired width according to the present invention. A plurality of plastic, or other material type, slats of desired length and width according to the specific use of the ripper are assembled together with at least one operator for the apparatus. As shown in FIGS. 6 and 7, a slat is aligned into the open front end 60 of the hollow body opposite the open back end 50 so that the slat is aligned with and introduced into the channel. While holding the hollow body in one hand and holding the slat aligned in the other hand, FIG. 8, the operator moves the apparatus and the slat in opposite directions so that the apparatus easily travels over and quickly cuts through the slat, FIG. 9. The operator may adjust the hand holding the slat to the back end 50 of the apparatus to receive the cut slat. Alternately, the operator may pull the entire length of slat through the apparatus. The loading and ripping steps are repeated until the desired number of ripped slats are achieved.

More than one operator may be used with the present invention, and the slat ripper may be constructed to receive and rip more than one slat at a time. Additionally, the slat ripper of the present invention may be fixedly attached to a stand or other permanent device for ease of operation as befitting the volume of slat to be ripped.

The foregoing description of preferred embodiments is not intended to impliedly limit the scope of protection of the following claims. Accordingly, for example, except where they are expressly so limited, the claims are not limited to rippers for plastic fence slat materials. Although the invention has been described in some detail with reference to the preferred embodiments, those of skill in the art will realize, in light of the teachings herein, that certain changes and modifications can be made without departing from the spirit and scope of the invention. Therefore, the invention is limited only by the claims.

I claim:

1. A slat ripper, comprising:

a hollow body comprising a longitudinal axis, a front end, a back end, a top wall, a bottom wall, two side walls, wherein each such wall has an inside and an outside face, and wherein the ends of the body are open, said hollow body having an internal portion defining a chamber of uniform cross-sectional geometry; and cutting means comprising a cutting end and a non-cutting end fixedly disposed within the body chamber between and attached to the inside faces of the top wall and the bottom wall, wherein the cutting end of the cutting means is exposed only to the chamber;

wherein the cutting means further comprises material formed by cutting a right triangular slot into the back end of the top wall, wherein the cut wall material is bent inwards generally perpendicularly to the top wall and extends to the inner face of the bottom wall, and wherein the cut wall material is curved defining a curved portion cutting edge directed towards the front end, and wherein the cutting edge directed towards the front end is sharpened to form a blade.

2. The apparatus according to claim 1, wherein the body further comprises two U-shaped channels and means to fixedly attach one channel to the other.

3. The apparatus according to claim 2, wherein the uniform cross-sectional geometry is a rectangle.

4. The apparatus according to claim 3, wherein at least one slat from a plurality of uniformly sized slats is provided and the cross-sectional area of the chamber is sized slightly larger than the cross-sectional area of at least one slat of the slats provided wherein the apparatus can receive at least one slat within the inner wall faces along the chamber longitudinal axis of the apparatus.

5. The apparatus according to claim 4, wherein the apparatus is constructed of twenty gauge stainless steel.

6. The apparatus according to claim 5, wherein the means to fixedly attach one channel to the other further comprises two spot welds equidistantly spaced on each side wall wherein an outside face of one channel wall is thus welded to an inside face of the other channel wall to form one conjoined side, with the reverse relationship with respect to the respective inside-outside faces of the channel walls on the other conjoined side, and a spot weld attaching the curved portion of the cutting means to the inside face of the bottom wall.

7. The apparatus according to claim 6, wherein the slat hollow body further comprises an external height dimension of 0.5 inches, an external width dimension of 2.5 inches, an external length dimension of 4.0 inches, and the dimensions of the triangle provided by the slot are a hypotenuse of 1.25 inches, a height of ⅝ inches, and a base of ⅞ inches.

8. The apparatus according to claim 7, wherein the blade is located 1.5 inches from the outside face of one side wall.

9. The apparatus according to claim 6, wherein the slat hollow body further comprises an external height dimension of 0.5 inches, an external width dimension of $2\frac{15}{16}$ inches, an external length dimension of 4.0 inches, and the dimensions of the triangle provided by the slot are a hypotenuse of 1.25 inches, a height of ⅝ inches, and a base of ⅞ inches.

10. The apparatus according to claim 9, wherein the blade is located 1.5 inches from the outside face of one side wall.

11. The apparatus according to claim 1, wherein the apparatus is constructed from molded, high impact graphite.

12. A slat ripper, comprising:

a hollow body constructed of twenty gauge stainless steel comprising a longitudinal axis, a front end, a back end, a top wall, a bottom wall, two side walls, wherein each such wall has an inside and an outside face, wherein the ends of the body are open, and wherein the hollow body has an internal portion defining a chamber of uniform cross-sectional geometry, an external height dimension, an external width dimension, and an external length dimension;

a blade having a cutting edge and formed by cutting a right triangular slot into the back end of the top wall, wherein the cut wall material is bent inwards generally perpendicularly to the top wall and extends to the inner face of the bottom wall, wherein the cut wall material is curved defining a curved portion cutting edge is directed towards the front end; and wherein the blade is located 1.5 inches from the outside face of one side wall.

13. The apparatus of claim 12, wherein the hollow body further comprises an external height dimension of 0.5 inches, an external width dimension of 2.5 inches, an external length dimension of 4.0 inches, and the dimensions of the triangle provided by the slot are a hypotenuse of 1.25 inches, a height of ⅝ inches, and a base of ⅞ inches.

14. The apparatus of claim 12, wherein the hollow body further comprises an external height dimension of 0.5 inches, an external width dimension of $2\frac{15}{16}$ inches, an external length dimension of 4.0 inches, and the dimensions of the triangle provided by, the slot are a hypotenuse of 1.25 inches, a height of ⅝ inches, and a base of ⅞ inches.

* * * * *